US005640702A

United States Patent [19]

Shultz

[11] Patent Number: 5,640,702

[45] Date of Patent: Jun. 17, 1997

[54] METHOD OF AND SYSTEM FOR TREATING MIXED RADIOACTIVE AND HAZARDOUS WASTES

[76] Inventor: Clifford G. Shultz, 1701 Glendale Ave., Evansville, Ind. 47712

[21] Appl. No.: 299,603

[22] Filed: Sep. 1, 1994

Related U.S. Application Data

[63] Continuation-in-part of Ser. No. 852,543, Mar. 17, 1992, abandoned.

[51] Int. Cl.[6] ..... G21F 9/00

[52] U.S. Cl. ..... 588/1; 588/201

[58] Field of Search ..... 588/1, 201

[56] References Cited

U.S. PATENT DOCUMENTS

| | | | |
|---|---|---|---|
| 2,948,586 | 8/1960 | Moore . | |
| 3,099,555 | 7/1963 | Teitel . | |
| 3,271,133 | 9/1966 | Knighton et al. . | |
| 4,469,661 | 9/1984 | Shultz | 588/209 |
| 4,552,667 | 11/1985 | Shultz | 588/201 |
| 4,571,307 | 2/1986 | Bonniaud et al. | 252/628 |
| 4,599,141 | 7/1986 | Shultz | 201/2.5 |
| 4,666,696 | 5/1987 | Shultz | 588/200 |
| 4,695,447 | 9/1987 | Shultz | 588/201 |
| 5,188,649 | 2/1993 | Macedo et al. | 65/21.3 |
| 5,202,100 | 4/1993 | Nagel et al. | 423/5 |
| 5,271,341 | 12/1993 | Wagner | 110/346 |
| 5,489,734 | 2/1996 | Nagel et al. | 588/1 |

*Primary Examiner*—Ngoclan Mai

*Attorney, Agent, or Firm*—Vorys, Sater, Seymour and Pease

[57] ABSTRACT

There is disclosed an improved method and system for the selective treatment and volume reduction of mixtures of gaseous, liquid and solid contaminated waste materials. The contaminated waste materials include mixtures of hazardous and/or radioactive wastes which react with selected active reducing metals in liquid form, preferably aluminum.

13 Claims, 1 Drawing Sheet

DISPOSAL SYSTEM 10

METHOD OF AND SYSTEM FOR TREATING MIXED RADIOACTIVE AND HAZARDOUS WASTES

This application is a continuation-in-part of U.S. patent application Ser. No. 07/852,543, Mar. 17, 1992 now abandoned.

BACKGROUND OF THE INVENTION

Immense quantities of waste materials have accumulated at Federal laboratories throughout the United States, and in other countries as well, as a result of the large amount of nuclear research in preparation of fissionable materials for atomic bombs including for use during World War II; in improvement of efficiency and recovery techniques of fissionable materials and fission fragments; and in development of uses for radioactive elements in industry, medicine, and commercial use. In many cases, the equipment used in handling these materials has been contaminated. Safety equipment used to prevent exposure of personnel to the radiation has also been contaminated. Because of this contamination, all of this equipment has been discarded. This, despite that fact that the actual contamination level is extremely low. As a result of this situation, in many cases tons of material have been discarded which has been contaminated with a few microcuries of radioactivity.

The ultimate result of all this is that there are literally millions of cubic yards of slightly contaminated materials which must be treated in order to reduce the sheer volume of material which must be stored in a permanent repository.

In addition to these slightly contaminated waste materials, there are also huge volumes of liquids and solids which may include some chemicals which are hazardous to human health, which may contain small or large quantities of radioactive materials. These may consist of animals which have been injected with radioactive chemicals; solutions of radioactive species used in experiments; mill tailings from radioactive ore beneficiation; tagged chemicals, and many others.

The entire problem is exacerbated by the fact that many of these materials were mixed indiscriminately when they were discharged, so that now there is no convenient way to separate the merely hazardous or radioactive from the non-hazardous or non-radioactive waste.

The present invention relates generally to a method of and system for reducing the gross volume of these contaminated wastes by exposing them to the surface of molten metallic aluminum. This metal can be pure aluminum metal, alloys, or eutectic mixtures of other metals which may be either more or less reactive than the aluminum. Such metals may include sodium, potassium, calcium, magnesium, lead, iron, zinc, copper, etc.

A number of successful approaches have been proposed by applicant for treating waste products. Some of these approaches are described in U.S. Pat. Nos.: 4,469,661; 4,552,667; 4,559,141; 4,666,696; and 4,695,447 and relate to the destruction of a variety of waste products, including biological waste products; hazardous waste containing organic compounds having covalently bound oxygen, nitrogen, sulfur or phosphorus; inorganic compounds which contain heavy metals or particular hazardous anionic groups or which are hazardous nonmetal oxides or sulfides; pathological materials; and hazardous halogenated hydrocarbon non-radioactive materials.

For instance, U.S. Pat. No. 4,469,661, describes a system for treating solids contaminated with polychlorinated biphenyl (PCB) and other hazardous halogenated hydrocarbons which are reacted with molten aluminum. Because of this reaction, chlorine will be abstracted from the organic materials, since aluminum chloride is formed which is a volatile salt that may be distilled from the reaction mixture. In this patented process, there is a direct reaction of the liquid PCB; the passage of PCB-contaminated oils or solvents through the reactor so that the PCBs react, and the oils are distilled from or carbonized in the reactor; or the extraction of PCBs from soil or other contaminated materials with a suitable high-boiling hydrocarbon solvent and subsequent passage through the reactor.

Still another approach is set forth in the U.S. Pat. No. 4,552,667 which patent describes a system for disposing of both liquid and solid hazardous wastes of the type including organic compounds which contain covalently bound oxygen, nitrogen, sulfur and/or phosphorus. In this approach, both liquid and solid hazardous wastes are pumped from a tank through a vat of molten aluminum wherein reacting vapors rise from the reaction zone into a water trap arrangement.

While these approaches are successful, there is nevertheless a continuing desire to improve upon their applicability and performance, especially from the standpoint of handling radioactivity. For instance, there is a continuing desire to economically reduce the volumetric amounts of waste materials generated at nuclear industrial or research sites; these wastes contain mixtures of various waste materials some of which are hazardous by reason of their radioactivity and others are hazardous by virtue of their nature. Such wastes include, for example, the radio-nuclides on wiping tissues which are saturated with chlorinated solvents; others are inorganic nuclides in the presence of solvents; some are radioactively labeled compounds. It will be appreciated that the volume of such wastes increases daily as research and nuclear power generation activities continue. Given the excessive damages that can arise from accidental discharge of pollutants, it can be extremely expensive to safely and legally dispose of such wastes. To minimize pollution problems, these hazardous and radioactive wastes must be treated and disposed of in accordance with stringent guidelines.

Prior efforts have not provided an entirely satisfactory and economical approach to reducing the volume of mixtures of wastes. For instance, at nuclear sites, the radioactive wastes are and have been stored in special containers and it is possible that such containers can include a variety of contaminants (including PCBs) in addition to radioactive contaminants. In order to safely dispose of the contents of such containers, especially older containers, an analysis of each is usually undertaken. The costs of such inspections can be extremely expensive—if not prohibitive—considering the large quantities of these containers which must be tested for proper disposal.

SUMMARY OF THE INVENTION

It is an object of the present invention to overcome shortcomings of the prior art and improve upon known waste disposal systems and methods.

It is another object of the invention to provide a system and method which are highly versatile since they can handle various mixtures of wastes.

It is another object of the present invention to reduce the contaminated wastes with a versatile method and system which allow the final disposable product to take such forms, so as to enhance waste disposal by reducing the volume of the final disposable product.

It is still another object of the present invention to provide a versatile system and method in which the physical form of the final disposable product can be regulated by reaction with the molten reduction metal, whereby the final disposable product can be alloyed in molten metal, entrapped in the molten metal or removed as slag.

According to the present invention there is in one aspect provided a method of reducing the volume of liquid or solid contaminated waste materials. It includes the steps of: a) directing liquid or solid contaminated waste materials to a molten reducing metal reaction chamber; b) applying a reduction metal in molten form so as to contact the contaminated solid or liquid waste materials, entraining them; and, c) removing from the reaction chamber at least a portion of unreacted molten metal containing the products of reaction of the reacted waste materials to allow them to solidify; thereby producing a substantially less hazardous, less voluminous, or innocuous final product which is easily and safely disposable.

This method further comprises removing gaseous reaction products from the reaction chamber and passing them through a trap system, after which they are flared off to the atmosphere.

Also, the directing steps of the method include: a) directing liquid, solid, or gaseous contaminated waste materials to the reaction chamber; b) directing the molten metal to the reaction chamber in such a way as to maximize contact between the metal and the contaminated waste; c) directing the gaseous reaction products to a suitable separator system outside the reaction chamber; d) directing the molten aluminum, with its burden of solid and alloyed reaction products, into a chamber where the oxides of reaction products can be removed; e) directing the remaining molten metal to a means by which it can be recirculated into the reaction chamber to react with more contaminated wastes, thereby comprising a continuous process. In this manner, the reaction products formed from the contaminants can be removed in solid form, as slag or dross forms and gaseous forms, depending upon the chemical nature of the waste materials and the products. A physical state that can be regulated is the vapor pressure of some of the more volatile elements. Thus, raising the temperature above the boiling point of an element can result in its vaporizing over to a trap.

In an illustrated embodiment, the applying step includes applying liquid aluminum to effect the chemical reduction of the contaminated waste and entrainment of the reaction products. Specifically, the liquid or solid waste contaminants are contacted with the liquid aluminum, as by a showering of the contaminated wastes with the liquid aluminum.

According to the invention a system is provided for reducing the volume of liquid, gaseous or solid contaminated waste materials, or any mixture of gaseous, liquid or solid waste materials. In essence, the system comprises means for directing gaseous, liquid or solid contaminated waste materials to a molten reducing metal reaction chamber; molten reducing metal reduction chamber means operable for reacting with the contaminated materials; means for applying a reduction metal in molten form so as to contact the contaminated solid, liquid or gaseous waste materials in the reaction chamber means; thereby chemically reducing the contaminated waste materials; and, means for removing at least a portion of reacted molten metal and the reacted products of waste materials from the reaction chamber so as to allow them to solidify thereby producing a substantially less hazardous or innocuous final product which is easily and safely disposable and occupies substantially less volume. Dilution by the unreacted metal may make it possible to dispose of it as a "low-level" waste.

In an illustrated embodiment, the removing means includes a trap assembly, wherein the trap assembly removes condensable materials which are vapors at the temperature of molten metal, as they are swept from the reaction chamber by the gaseous reaction products.

In another aspect, the applying means may be operable for applying liquid reducing metal such that the liquid, solid, or gaseous waste contaminants are contacted with the liquid reducing metal. In another aspect, the liquid, solid or gaseous contaminated wastes may be showered with the liquid reducing metal.

Other objects and further scope of applicability of the present invention will become apparent when taken in conjunction with the accompanying drawing.

DETAILED DESCRIPTION

Figure 1:
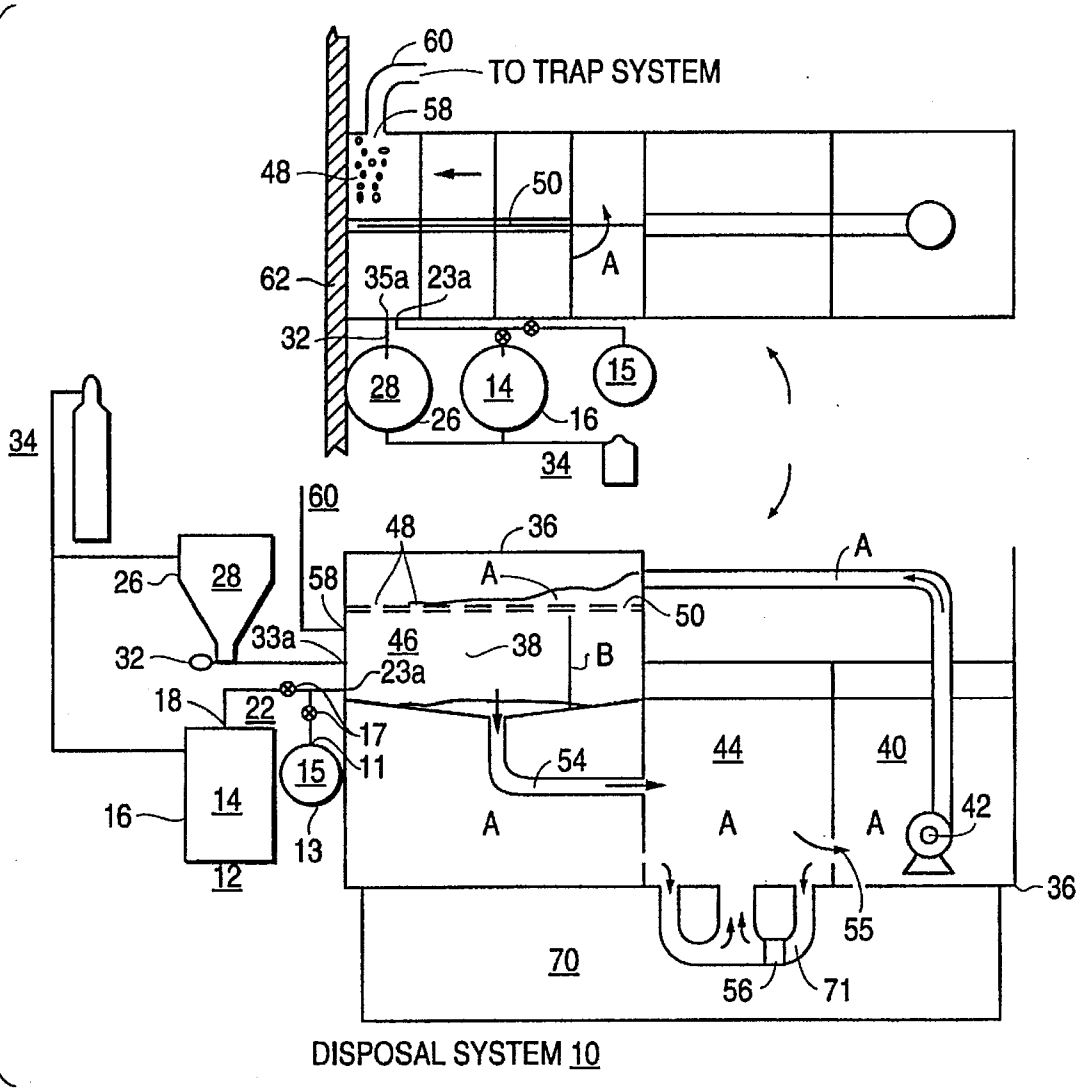
FIG. 1 illustrates the method and system for treating mixed radioactive and hazardous wastes of the invention.

Reference is made to FIG. 1 for schematically illustrating a preferred embodiment of an improved waste disposal system 10 made according to the principles of the invention (the present application for which is a continuation-in-part of U.S. patent application Ser. No. 07/852,543, pending, incorporated by reference). In the illustrated waste disposal system 10, the volume of mixtures of solid, liquid and gaseous contaminants is diminished significantly through reduction or entertainment with a molten reducing metal, such as aluminum. In the specification and claims, the term "contaminant" is inclusive of a variety of wastes which are considered hazardous or radioactive, or both. It also includes inherently non-radioactive and non-hazardous wastes which, however, become hazardous or radioactive because of being admixed with hazardous or radioactive waste materials.

For example, the solids which can be treated include non-radioactive, non-hazardous implements and materials of metal, plastic, glass, paper, or biological materials which have been used, treated with, or contaminated by radioactive materials; and with otherwise hazardous materials in the form of solvent, chemical reagents, poisons, or diseased biological materials.

The hazardous materials can include a group comprising solvents, chemical reagents, poisons, or diseased biological materials and which have been used in conjunction with, or contaminated by, radioactive materials. The non-radioactive, non-hazardous waste materials may include syringes, needles, animal cages, specimen containers, glass tubes, vials, caps, tissues, towels, clothing, surgical implements, mechanical contrivances, and any other implement or device used in experimentation, industrial use or power generation using radioactive materials, and which have been or may have been contaminated by radioactive materials.

The radioactive materials may be any radio-nuclide occurring naturally; those that have been produced by nuclear fission or fusion, or by particle accelerators or other artificial means. The radioactive materials may include deliberate or accidental inclusion in a solvent, reagent or biological material. For instance, the radioactivity can be attributable to nuclear fuel, uranium, or other fuel processing and radiopharmaceuticals.

The hazardous solvents, chemical reagents or poisons may include: a) halogenated hydrocarbons, including polychlorinated biphenyls, chlorinated dioxins, chlorinated furans, and all aromatic and aliphatic organic compounds, solvents, insecticides or herbicides which are partially or completely chlorinated; b) hazardous halogenated or non-halogenated organic compounds containing as substituents, oxygen, nitrogen, sulfur or phosphorus, either singly or in combination with other elements; to include aldehydes, ketones, alcohols, carboxylic acids, esters, ethers, nitriles, amines, sulfides, thiols, thioketones, thiocarbonyls, mercaptans, phosphates, phosphites, phosphonates, phosphines and phosphine oxides, nitro compounds, nitroso compounds, amides, and amino acids, amino alcohols, sulfonic acids, sulfonates, and sulfones, thioamines, aminothiols, and any other combinations of these with each other, or with other elements; c) nerve gases and other cholinesterase inhibitors; mustard gases; and other military chemical agents; d) heavy metal oxides, sulfides and selenides; e) anionic groups containing heavy metal and oxygen, sulfur or selenium; f) phosphorus and selenium sulfides and oxides; g) oxidizing anionic groups containing halogen; h) anionic groups containing sulfur or nitrogen; i) hazardous halides; and j) cyanides.

The biological materials may include tissues from animals, biological fluids, infectious bacteria, viruses, spores, or carcinogenic agents.

Reference is now made back to the drawing wherein the illustrated waste disposal system 10 includes a liquid storage assembly 12. The assembly 12 receives, stores, and dispenses contaminated liquid waste materials 14. As will be discussed, a wide variety of liquid wastes are contemplated. The storage assembly 12 includes a liquid storing tank or vessel 16 of a type suitable for receiving, holding and dispensing the particular kind of liquid contaminants 14 which are to be processed by the system 10. For example, since a contaminated liquid waste material 14 may include radioactive components then the storing tank 16 would be provided with suitable shielding for such radioactivity. The storage tank 16 is associated with an appropriate pumping and valving mechanism 18 and controls (not shown) therefor which are operable for allowing controlled discharge of preselected amounts of contaminated liquid waste materials 14 to an exit pipe 22 nd then to a liquid metal chemical reactor unit 38 to be described. The storage tank 16 is provided with doors or chutes (not shown) for permitting feeding of the wastes thereinto in either batch or continuous modes. Moreover, it is suitably lined with an appropriate lining material (not shown) to handle the contaminated wastes to be processed. For instance, the liquid wastes 14 could be transformer oils contaminated by PCBs.

The system 10 also includes a gas storage cylinder 13 of a type suitable for receiving, holding, and dispensing the particular kinds of gaseous contaminants 15 which are to be processed by the system 10. Suitable valving 17 allows for both liquids and gases to utilize the same injection port.

The system 10 also includes a sealed hopper 26 which is used to receive, store and dispense contaminated solid waste materials 28. The sealed hopper 26 is also provided with doors or chutes (not shown) for permitting batch or continuous feeding thereinto. It is desirable to minimize the quantity of moisture present in the feedstock. The contaminated solid waste materials 28 can comprise a variety of wastes as described herein. The sealed hopper 26 is provided with an outlet that is under the control of a suitable conveying mechanism 32 which transports the same to the liquid metal chemical reactor unit 38. The conveying mechanism 32 in this embodiment is a screw-type feed conveyor which leads to the reactor unit 38. Other types of solid feeders are, of course, envisioned.

The present invention may include either the liquid, gaseous or solid feed operation.

A pressurized gas system 34 is provided which directs an inert gas under positive pressure to the cylinder 13, the tank 16, or to the hopper 26 so as to enhance the feeding operation and prevent back-up and primarily to purge the system when shut down for maintenance.

The present invention contemplates treating in a new and improved manner not only the hazardous liquid and solid wastes that are described in U.S. Pat. Nos. 4,469,661; 4,552,667; 4,599,141; 4,666,696; and 4,695,447, but those contaminated by radioactivity from a variety of sources. A description of those materials and the reactions which occur when using heated powdered aluminum, molten aluminum and/or other like reducing metals are incorporated herein by reference.

As will be explained in the following examples, the liquid aluminum A chemically reduces the non-radioactive hazardous and non-hazardous waste materials such that there results a much lower volume of wastes, contaminated only with radioactivity; thus removing the hazardous materials, and encapsulating most of the radioactive materials in final form for disposal.

Referring back to the liquid metal chemical reactor, it is seen to include an appropriately environmentally sealed housing assembly 36 which defines a liquid metal application and reaction chamber 38. The application and reaction chamber 38 can be lined with a refractory ceramic material. The application and reaction chamber 38 allows introduction of the contaminated solid, gaseous and liquid wastes, as well as permits the liquid or molten metal to be applied. A furnace for heating the system 70, also supports the chamber 38, and heating may for instance be by induction coils. In the application and reaction chamber 38, molten or liquid metal A is dispensed so as to contact the external surfaces of the solid waste materials 28 as well as the vapors formed by the evaporation of the liquid waste materials 14, or the gaseous materials 13. Aluminum is preferred as a reducing metal because of its low melting point, ready availability, stability at ordinary temperatures and volatility of its anhydrous chloride salt. Other metals have some of these desirable chemical properties including alkali metals, alkaline earth metals, iron, zinc and the rare earth metals, but aluminum is more active than some and much easier and safer than others to handle and ship.

The housing assembly 36 including the liquid metal application chamber 38 are suitably insulated, closed and sealed to prevent undesired escape of the contaminants and other materials as well as prevent the inclusion of oxygen. They are also suitably thermally insulated to insure that the desired chemical reactions are carried out and that there is an adequate flow of the reacted mass of metal. In addition, the application chamber 38 is radioactively shielded with a lead partition 62. For effecting efficient contact, molten metal A is pumped from a suitably heated and insulated reservoir 40 by a pumping mechanism 42 also located in the reservoir. The level of liquid aluminum A maintained in a molten bath or pool 44 is such as to prevent the escape of gaseous reaction products or the incursion of oxygen; as well as to provide adequate metal to the pump intake. The gaseous, liquid and/or solid waste materials 13, 14 and 28 entering the application and reaction chamber 38 are contacted by a shower 46 of molten metal A. The molten metal shower 46 is achieved by reason of pumped liquid metal A descending through a plurality of spaced openings 48 which are defined by an arrangement of perforated plates 50 each having a multiplicity of fine openings 48. The openings 48 are of such a size that they permit an adequate shower of liquid metal A for the purposes intended. For example, the perforated openings 48 may have sizes which range from ⅛ to ⅜ inches. It has been found that such a size range is adequate for purposes of generally evenly distributing the molten metal A to provide a circuitous path through the streams of reducing metal, to provide means for all gaseous material to react. The foregoing arrangement also allows for continuous renewal of molten metal A for effecting the desired contact. Of course, the foregoing metal application technique is but one preferred embodiment of many which may achieve the desired end of generally evenly contacting the gaseous, liquid, and solid waste materials 14, 28 with the molten metal A. For instance, the present invention contemplates effecting such contact through the utilization of a liquid curtain or flowing surfaces among other techniques. Some reacted solid contaminants, together with reacted salts of aluminum and unreacted oxides of metals more active than aluminum (Na, Ca, Mg, K, etc.) and unreacted liquid metal are carried in a stream to a return channel 54. The channel 54 is defined by a side wall of the reservoir 44 and an extended wall of the housing 36. This channel 54 generally directs the reacted solids coming from the chamber into reservoir 44 for easier subsequent removal, such as by fluxing and skimming the liquid from this channel, by means of remotely controlled apparatus (not shown). It also provides a seal to prevent the escape of gases or the incursion of oxygen. The slag and dross formed in the application and reaction chamber 38 can be skimmed from the bath 44 as necessary by a remotely operated skimmer (not shown) and placed in ingot molds (not shown) for subsequent disposal. A suitable screen or grid or the like (not shown) can be arranged in the bottom reservoir 44 near the channel 54 so as to restrain unmelted solids from blocking the channel 55 into the pump well and interfering with the pumping operation.

The present invention contemplates utilization of an ingot-forming mold (not shown) into which the withdrawn slag and reacted mass can be transferred. A standard molten metal tapping mechanism generally designated by reference numeral 56 is used for removing a portion of the unreacted liquid metal and waste material reaction products from the channel 71 for forming an ingot. In this manner the reacted gaseous, solid and liquid waste materials are reacted to a less hazardous and/or innocuous state and encased in the reducing metal, thereby producing a readily disposable ingot which contains the radioactive elements from the waste materials. Those ingots formed when a radioactive melt is tapped are, of course, radioactive, so the operation must be remotely operated. This mode has the further advantage that the metallic and metal oxide residues can be cast as ingots or bricks of a size that can allow the radioactive heat to dissipate thermally.

It will be appreciated that the temperature of the reservoir 40 as well as the application and reaction chamber 38 are such as to insure that the metal remains molten. For example, if the molten bath 44 is to be substantially completely aluminum, temperatures ranging from about 600° C. to about 3000° C. are ordinarily useful, while temperatures ranging from 780° C. to about 1000° C. are preferred. An eutectic melt containing 10% aluminum and 90% zinc can be used to operate at a much lower temperature. Continuous addition of aluminum would be necessary, since it is the more active of the two metals and will react preferentially. Those waste materials, especially radioactive waste, having a melting point above the temperature of the molten metal may not become alloyed with the molten metal, but rather entrained therewith. Accordingly, the unalloyed waste material will be encased in metal ingots when finally tapped and molded. As a consequence, the waste materials will be alloyed with the metal or will remain in suspension in the molten metal. Of course, by controlling the temperature of the molten metal between the melting and boiling points of the radioactive elements, such action will control whether the radioactive elements vaporize, or react with the metal and become soluble therein. Thus, it will be appreciated that in terms of the radioactive waste materials generated for example, in medical therapy, the final form of the disposable product will vary dependent on the type of radioactive material treated. The separation of such radioactive materials as iodine, gallium, cesium, strontium 90, thallium, etc., will depend upon their reactivity with molten aluminum, temperature of the molten aluminum compared to the melting temperatures of the radioactive materials and the vaporization temperatures of the radioactive elements. Any oxides of active metals will result in a dross material that is subsequently drawn-off along with aluminum oxide. It will be further appreciated that the radioactivity will reside in a few elements that will react with the aluminum accordingly. It has been found, however, that higher temperatures diminish the viscosity of the molten metal. There is greater contact between the liquid aluminum (or other metals or alloys, including for instance scrap metals) and the solid wastes being treated as well as higher rates of reduction. The molten shower 46 also presents continuously renewed reactive surfaces for contacting. For instance, the reservoir 40 need not have the configuration shown, however, the chamber 44 should be in fluid communication with the reactor unit. While this embodiment illustrates that the gaseous, liquid and solid waste materials are introduced into a reaction zone of the chamber 38 through inlets 22*a* an 32*a*, it will be appreciated that other feeding approaches are contemplated so as to insure intimate contact of the molten metal with the gaseous, solid and liquid waste materials.

Referring back to the application and reaction chamber 38, it is also noted that gases will be formed as a reaction product of some of the contaminated waste materials and the liquid metal A. In these situations, reacted waste gases and particulates are vented through an appropriate vent opening 58 by means of a vent pipe 60 to a contaminant gas trap and scrubber (not shown). Such gases will comprise primarily hydrogen from the decomposition (reduction) of water and organic compounds and some hydrocarbons from the reduction of organic compounds. It is advisable to minimize moisture quantity in the feedstock to avoid excessive use of molten aluminum.

In the embodiment illustrated in FIG. 1, the system includes the arrangement wherein it is mounted on a heating means 70 which may be an induction furnace or other furnace of a known type. In this arrangement the reservoir for the molten reduction metal A is connected by suitably enclosed, sealed and insulated channels 71. The furnace portion 70 will support the housing assembly 36 of the reactor unit 38. The return channel 54 formed in the housing assembly 36 communicates with channel 71 in the furnace portion 70 so as to allow circulation of the molten metal to the heating means and back to the metal pump 42. The pump 42 forces the molten metal A to and through openings 48 in the perforated plate 50 supported by baffles B. It will be noted that the skimming system (not shown) described above can be connected to the reservoir portion 44 to perform the functions described earlier.

It is to be understood that, because the embodiment is designed to reduce the material of "mixed" wastes, (i.e.

wastes containing both hazardous and radioactive wastes) the physical orientation of all the parts must be such as to allow for shielding for all radioactive materials in order to minimize personnel exposure to radiation. Such a configuration is shown in FIG. 1, showing radiative shield partition 62, which allows personnel to work in the vicinity of the system without undue exposure to radiation.

To better understand why aluminum is preferred in the inventive system and process it will be realized that aluminum is an active reducing agent, both in aqueous systems, and in the molten state. For instance, it is capable of: a) reducing halogenated organic compounds to carbon, hydrogen or low-molecular weight hydrocarbons; forming aluminum chloride; b) reducing ethers, esters, carboxylic acids, alcohols, and carbohydrates to carbon, hydrogen, and hydrocarbons, forming aluminum oxide; c) reducing amines, ammonia, and ammonium compounds to nitrogen, hydrogen, carbon, and forming aluminum nitride; d) reducing the halogen salts (chloride, bromide, iodide, astatide) of nearly all the metals, forming aluminum halides, some of which are volatile; e) reducing sulfate, nitrate, phosphate, arsenate, selenate and the oxyacid salts of transition metals (chromate, permanganate, etc.) to form aluminum sulfide, aluminum nitride, nitrogen, phosphorus arsenic, aluminum selenide, and the elemental form of the metals, respectively; f) reducing the oxides of many metals to the metallic form, which will alloy with the aluminum (i.e. dissolve in it), and g) reducing oxy-acid and organic acid salts of most "heavy" metals, leaving either the elemental metal dissolved in the aluminum or an oxide in the dross.

Moreover, the following describes certain elements whether radioactive or not, and their reaction in the presence of molten aluminum:

Group IA Metals: Aluminum will react with the halides to form aluminum chloride thus reducing these on a transient basis. The metal thus formed will react immediately with any oxygen-containing compound, reducing it and forming the metal oxide, which will remain as a slag on the molten metal surface. Those in the form of salts of oxy-acids will be decomposed by the reduction of the sulfate, nitrate, etc., and react to form the oxide. Those present as oxide will be unaffected, and will merely add to the mass of slag.

Group IIA: Aluminum will reduce beryllium, magnesium and calcium to the metallic form. These will remain alloyed with the aluminum and add to the reductive mass (i.e. they will serve as reducing agents, probably dissolved in the molten aluminum). Strontium, barium and radium will form oxides and remain as part of the slag on the surface of the aluminum pool.

Group III: Boron, gallium, indium and thallium will be reduced and alloy with the aluminum. Scandium, yttrium, and the rare earths, (i.e. lanthanides and actinides) are similar to aluminum as reducing agents. They will either be reduced and remain alloyed with the aluminum, or form the oxide and remain in the slag.

Transition Metals will be reduced to the metal, when fed to the aluminum system, regardless of their oxidation state. These will remain alloyed with the aluminum. The presence of high quantities of these in the melt may eventually require tapping the melt to preclude having to raise the temperature too high in order to keep it molten. The coinage metals, copper, silver, gold, platinum, etc., will be reduced to the metals and remain alloyed with the aluminum.

Zinc, cadmium and mercury will be reduced to the elemental state. Some of the zinc may remain alloyed with aluminum. Part of the zinc, and all of the cadmium and mercury will distill from the melt to be trapped in the trap system.

It is understood that radioactive elements are chemically identical to stable (non-radioactive) elements. Therefore the reactions which take place with aluminum will take place with radioactive and non-radioactive elements alike.

Hereafter follows several examples relating to the system and method of the invention. It is to be understood that these examples are illustrative, rather than limiting. Examples in the cited patents are also included by reference.

EXAMPLE 1

A transformer oil was heated for 30 minutes in a sealed tube with aluminum foil at 500° C. This resulted in recovery of 21.5% chloride. This indicates that, in the absence of intimate contact with the solid metal, there is an appreciable time requirement. This should be obviated by the use of molten metal.

EXAMPLE 2

The melting point of aluminum is 660° C. Addition of zinc metal lowers the melting point to a minimum at 382° C. At this point, the zinc must be 95% of the melt, and might become a major reactant, resulting in the formation of ZnCl, which would separate in the molten state. The use of an intermediate concentration of zinc could lower the temperature to obtain the optimal conversion reaction. Since the aluminum reacts preferentially, it would be possible to feed in fresh aluminum as it is removed by the reaction.

EXAMPLE 3

Aluminum forms a eutectic mixture with 13% magnesium and 8% zinc. This has a minimum melting point at about 500° C. It is advisable to operate at the lowest possible temperature at which the desired reactions take place efficiently. This may allow some solvents or transformer oils to pass through the system without thermal decomposition. The preponderance of aluminum in this system makes it economically desirable compared to the high zinc eutectic.

EXAMPLE 4

N-Butyl alcohol was immersed in molten aluminum. A gas was generated which corresponded to a mixture of hydrogen and 1-butene. Aluminum oxide formed.

EXAMPLE 5

Dimethyl phthalate is substituted for the butanol in Example 4 with the result that the dimethyl phthalate is destroyed and hydrocarbon gas and hydrogen are produced.

EXAMPLE 6

Acetonitrile was destroyed by immersion in molten aluminum. No cyanide or cyanogen was detected in either the evolved gas or in the cooled melt.

EXAMPLE 7

Naphthylamide was immersed in molten aluminum and reacted with evolution of gas. Neither the gas nor the solid residue contained any traces of amine. Ammonia was found on treating the solidified metal with water, indicating the formation of aluminum nitride. Carbon was also found on the surface.

EXAMPLE 8

Carbon disulfide decomposed rapidly upon treatment with molten aluminum, generating gaseous sulfur. The cooled melt contained both aluminum and sulfur.

EXAMPLE 9

A mixed alkyl benzene sulfonate was destroyed by molten aluminum, generating a combustible gas and leaving aluminum sulfide and carbon in the metal.

EXAMPLE 10

A 25 ml sample of malathion pesticide formulation (a surrogate for nerve gases VX, Soman, etc.), which contained 15 g of malathion and 9.5 g of xylene, was vaporized in the preheater and the vapors sprayed into the molten aluminum bath which was at 870° C. It passed through six to twelve inches of aluminum, and the gaseous products were trapped in the water trap by displacement of water. The total vapor produced amounted to 16.6 liters. A volume of 19.2 liters was calculated to be the total volume based upon reactions which assume the total decomposition of the xylene. No detectable malathion remained in the vapors.

EXAMPLE 11

A 1.8573 gram sample of arsenic trioxide is mixed with 5 g of powdered aluminum in a crucible and heated to the melting temperature of aluminum. A current of air is drawn through a funnel above the crucible and through a cold trap. Elemental arsenic is condensed in the trap and in the connecting tube.

EXAMPLE 12

A 0.5055 g sample of mercuric oxide was mixed with 5 g of aluminum powder and heated to the melting point of aluminum. The resulting vapors are passed over a cold trap where they are condensed. The deposit is dissolved in nitric acid and the presence of mercury is confirmed by atomic absorption spectrophotometry.

EXAMPLE 13

Osium tetroxide is contacted with molten aluminum. Osmium metal forms and dissolves in the aluminum.

EXAMPLE 14

Vanadium pentoxide is contacted with molten aluminum. Vanadium metal forms and dissolves in the aluminum and alloys therewith.

EXAMPLE 15

A 0.1424 g sample of freshly precipitated copper sulfide was heated with molten aluminum. The reaction was exothermic, and the copper was reduced to metals which dissolved in the molten aluminum and alloyed therewith. Aluminum sulfide was present in the slag.

EXAMPLE 16

Molten aluminum was poured into a crucible containing 3.0 g sodium chromate. The chromate ion was reduced to chromium metal which dissolved in the melt, leaving no trace of oxidizing chromate ion. Sodium and aluminum oxides were left in the residue.

EXAMPLE 17

A mixture of 0.5515 grams of potassium permanganate and 1.6017 grams of powdered aluminum was heated in a furnace. Vigorous exothermic reaction starts at about 600° C. reducing the permanganate to manganese metal, which alloys with the aluminum. No trace of permanganate remains.

EXAMPLE 18

5.0 ML of 5% sodium hypochlorite solution was mixed with 5.21 g aluminum powder in a crucible, and evaporated to dryness. When dry, it was heated to 700° C. in a muffle furnace. When cooled to room temperature, the solids remaining were titrated with deionized water and filtered. No chlorine or other oxidizing agent is detected. Chloride ion is detected, indicating reduction of 99.9% of the hypochlorite ion.

EXAMPLE 19

A 0.5 gram sample of sodium perchlorate was heated to 700° C. in contact with powdered aluminum. Aqueous extract of the cooled solids showed the absence of any oxidizing agent, and the presence of chloride ion, indicating the complete reduction of the chlorate.

EXAMPLE 20

A 0.5 gram sample of thallium nitrate is heated in a crucible with powdered aluminum while a current of air is drawn through a funnel above the crucible through a cold trap. Elemental thallium condenses in a trap and in the connecting tube. A test for nitrate was negative.

EXAMPLE 21

1.1044 g of sodium sulfate was heated at 700° C. in contact with powdered aluminum. The characteristic odor of hydrogen sulfide is detected in the cooled residue, indicating reduction of the sulfate. No sulfate was detected.

EXAMPLE 22

1.0179 g of sodium cyanide was heated to the melting point of aluminum in powdered aluminum. Analysis of the product indicates only a negligible amount of cyanide (4.5 mg/kg).

EXAMPLE 23

A hazardous waste mixture consisting of plating plant sludge from a cyanide brass plating process is dried and conveyed into molten aluminum. The cyanide is destroyed by conversion to carbon and nitrogen. Copper metal and zinc metal remain dissolved in the aluminum as harmless alloying metals.

EXAMPLE 24

A disposed plastic syringe used for injecting a small volume of radioactive thallium 201 chloride into a human, for example for use in intravenous myocardial perfusion, is placed in the system as illustrated in FIG. 1 and is introduced into the molten aluminum at a temperature in excess of 710° C., wherein the plastic syringe decomposes and the thallium is reduced and vaporizes and is removed by condensation.

EXAMPLE 25

Inserting a plastic syringe containing a residue of strontium 85, which has been injected into a patient in a solution prepared from strontium chloride, into the system shown in FIG. 1 so that the syringe is placed in the molten aluminum at a temperature in excess of 873° C. so that the plastic syringe decomposes and the strontium will form an oxide and remain as part of the slag in the aluminum pool and the resulting aluminum chloride will vaporize and be trapped in the trap system.

It is understood that the invention can be practiced with any of the procedures on any halogenated wastes, whether hazardous or not; using any metals or mixtures of metals, under various conditions of temperature and pressure; including those set forth hereinabove but not limited thereto. The selection of the metals, eutectic mixtures, temperatures and apparatus can be varied. Those skilled in the art can readily vary and adapt the teachings of the invention to a set of circumstances found in a certain situation.

Clearly, the method and system of the present invention are highly versatile insofar as they can handle a variety of waste mixtures including radioactive wastes in a manner whereby the contaminated materials and, in particular, radioactive materials can be controlled by virtue of the temperature of the molten reducing metal (e.g. aluminum) relative to the melting and boiling points of the radioactive elements and compounds being treated.

Since certain changes may be made in the above described apparatus and method without departing from the scope of the invention involved, it is intended that all master contained in the description thereof or shown in the accompanying drawings shall be interpreted as illustrative and not in a limiting scope.

What is claimed is:

1. A method of reducing the volume of any individual or combination of a) hazardous wastes which are contaminated with radioactive wastes, b) non-hazardous materials which are contaminated with radioactive wastes, c) non-hazardous wastes which are contaminated with hazardous wastes, the method comprising the steps of:

(a) directing the solid, liquid, or gaseous contaminated materials to a molten reducing metal reaction chamber;

(b) applying a reduction metal in molten form so as to contact the contaminated waste materials in the reaction chamber, thereby chemically reducing them to moieties which are nontoxic except by virtue of their radioactivity;

(c) removing at least a portion of unreacted molten metal and reacted waste materials from the reaction chamber so as to allow them to solidify thereby producing a substantially less hazardous final product which is easily and safely disposable in a significantly smaller space than that occupied by the original waste materials; and (d) showering the hazardous material with the molten metal by means of a shower or curtain of molten metal in the reaction chamber.

2. The method of claim 1 wherein said showering step (d) provides a circuitous path for the gases and vaporized solid or liquid contaminants and their reaction products to pass through to insure complete reduction.

3. A method of reducing the volume of any individual or combination of a) hazardous wastes which are contaminated with radioactive wastes, b) non-hazardous materials which are contaminated with radioactive wastes, c) non-hazardous wastes which are contaminated with hazardous wastes, the method comprising the steps of:

(a) directing the solid, liquid, or gaseous contaminated materials to a molten reducing metal reaction chamber;

(b) applying a reduction metal in molten form so as to contact the contaminated waste materials in the reaction chamber, thereby chemically reducing them to moieties which are nontoxic except by virtue of their radioactivity, said step of applying including applying liquid aluminum from a reservoir to contact the gaseous, liquid or solid waste contaminants to effect reduction, and a sub step of recirculating the showered aluminum from the reservoir to the reaction chamber;

(c) removing at least a portion of unreacted molten metal and reacted waste materials from the reaction chamber so as to allow them to solidify thereby producing a substantially less hazardous final product which is easily and safely disposable in a significantly smaller space than that occupied by the original waste materials; and (d) showering the hazardous material with the molten metal by means of a shower or curtain of molten metal in the reaction chamber.

4. The method of claim 1 wherein the molten metal comprises other metal contaminants which may be inert to reaction.

5. A method of chemically reducing waste materials, including mixtures of wastes which are both hazardous and radioactive, or non-hazardous and radioactive, comprising the steps of:

(a) directing gaseous, or liquid wastes from a first source thereof to an operating chamber;

(b) directing solid wastes from a second source thereof to the operating chamber;

(c) providing a source of molten aluminum at the operating chamber;

(d) contacting the waste materials with the molten aluminum, said contacting the molten aluminum being done in such a manner that the aluminum contacts the waste materials and their reaction products for a sufficiently long time to bring about complete reduction reactions therewith to thereby diminish the volume of the hazardous and radioactive waste materials.

6. The method of claim 5 wherein the waste materials are from a group including non-radioactive, non-hazardous implements and materials of metal, plastic, glass, paper, or biological materials which have been used, treated with or contaminated by radioactive materials.

7. The method of claim 5 wherein the waste materials are from a group containing hazardous materials in the form of solvents, chemical reagents, poisons, or diseased biological materials and which have been used in conjunction with, or contaminated by, radioactive materials.

8. The method of claim 5 wherein the waste materials are from a group including non-radioactive implements and materials of metal plastic, paper or biological materials which have been used, treated with, or contaminated by radioactive materials; and with otherwise hazardous materials in the form of solvents, chemical reagents, poisons, or diseased biological materials.

9. The method of claim 8 wherein the non-radioactive, non-hazardous waste materials may be from a group including syringes, needles, animal cages, specimen containers, glass tubes, vials, caps, tissues, towels, clothing, surgical implements, mechanical contrivances, and any other implement of device used in experimentation, industrial use or power generation using radioactive materials, and which have been or may have been contaminated by radioactive materials.

10. The method of claim 8 wherein the radioactive materials may be from the group including radio-nuclides occurring naturally; those that have been produced by nuclear fission or fusion, or by particle accelerators or other artificial means.

11. The method of claim 7 wherein the solvents, chemical reagents or poisons may be selected from: a) halogenated hydrocarbons, including polychlorinated biphenyls, chlorinated dioxins, chlorinated furans, and all aromatic an aliphatic organic compounds, solvents, insecticides or herbicides which are partially or completely chlorinated; b) hazardous halogenated or non-halogenated organic compounds containing as substituents, oxygen, nitrogen, sulfur or phosphorus, either singly or in combination with other elements; to include aldehydes, ketones, alcohols, carboxylic acids, esters, ethers, nitriles, amines, sulfides, thiols, thioketones, thiocarbonyls, mercaptans, phosphates, phosphites, phosphonates, phosphines and phosphine oxides, nitro compounds, nitroso compounds, amides, and amino acids, amino alcohols, sulfonic acids, sulfonates, and sulfones, thioamines, amino-thiols, and any other combinations of these with each other, or with other elements; c) nerve gases, cholinesterase inhibitors, mustard gases, and other military chemical agents; d) heavy metal salts, sulfates, sulfites, chlorides, nitrates, organic acid salts, heavy metal salts, oxides, sulfides and selenides, e) anionic groups containing heavy metal and oxygen, sulfur or selenium; f) phosphorus and selenium sulfides and oxides; g) oxidizing anionic groups containing halogen; h) anionic groups containing sulfur or nitrogen; i) hazardous halides; and j) cyanides.

12. The method of claim 6 wherein the biological materials are from a group including tissues from mammals, biological fluids, infectious bacteria, viruses, spores; or carcinogenic agents.

13. A method of reducing the volume of liquid, solid, gaseous radioactively contaminated waste materials including radioactive elements, comprising the steps of:

(a) directing liquid, solid and gaseous radioactive contaminated waste materials to a molten reducing metal reaction chamber;

(b) applying a reduction metal in molten form so as to contact the radioactive contaminated solid, liquid or gaseous waste materials in the reaction chamber thereby chemically reducing them, said step of applying including applying liquid aluminum to effect reduction;

(c) adjusting the temperature of the molten reducing metal so as to reduce the contaminated radioactive elements, and to vaporize the volatile radioactive elements;

(d) removing at least a portion of unreacted molten metal including the radioactive elements and the reaction products of reacted waste materials including the non-volatile radioactive elements as either a slag component or an alloyed component from the reaction chamber so as to allow them to solidify, thereby producing a substantially less hazardous final product which is easily and safely disposable in a significantly smaller space than that occupied by the original wastes;

(e) removing contaminated reacted or unreacted gases from the reaction chamber; and (f) trapping the volatile radioactive metals.

* * * * *